US011819897B2

(12) United States Patent
Yin et al.

(10) Patent No.: US 11,819,897 B2
(45) Date of Patent: Nov. 21, 2023

(54) APPARATUS AND METHOD FOR MANUFACTURING CONTINUOUS STIRRUP

(71) Applicant: RUENTEX ENGINEERING & CONSTRUCTION CO., LTD., Taipei (TW)

(72) Inventors: Samuel Yin, Taipei (TW); Shao Kuo Lu, Taipei (TW); Tai Shang Yang, Taipei (TW)

(73) Assignee: RUENTEX ENGINEERING & CONSTRUCTION CO., LTD., Taiwan (TW)

( * ) Notice: Subject to any disclaimer, the term of this patent is extended or adjusted under 35 U.S.C. 154(b) by 150 days.

(21) Appl. No.: 17/675,958

(22) Filed: Feb. 18, 2022

(65) Prior Publication Data

US 2022/0266325 A1 Aug. 25, 2022

(30) Foreign Application Priority Data

Feb. 24, 2021 (TW) ..... 110106444

(51) Int. Cl.

| | |
|---|---|
| ***B21D 11/12*** | (2006.01) |
| ***B21D 11/22*** | (2006.01) |
| *E04C 5/06* | (2006.01) |

(52) U.S. Cl.
CPC ..... *B21D 11/12* (2013.01); *B21D 11/22* (2013.01); *E04C 5/0622* (2013.01)

(58) Field of Classification Search
CPC ..... B21D 11/10; B21D 11/12; B21D 11/125; B21D 11/22; B21D 15/04; B21D 15/12; B21D 13/10; B21F 27/12; B21F 27/127
See application file for complete search history.

(56) References Cited

U.S. PATENT DOCUMENTS 4,383,430 A * 5/1983 Klaus ..... B21F 27/14 72/319
2007/0256466 A1* 11/2007 Anagnostopoulos ... B21F 27/20 72/294

* cited by examiner

*Primary Examiner* — Debra M Sullivan
(74) *Attorney, Agent, or Firm* — Juan Carlos A. Marquez; Marquez IP Law Office, PLLC

(57) ABSTRACT

A method for manufacturing a continuous stirrup and an apparatus for implementing such method are provided. The method includes placing a planar structure formed of a wave-shaped rebar on a platform, fixing a side of the planar structure and using an elongated mold to abut against the other side of the planar structure to form an intermediate structure, flipping the intermediate structure, and abutting the elongated mold against the side of the planar structure to form a continuous stirrup.

20 Claims, 18 Drawing Sheets

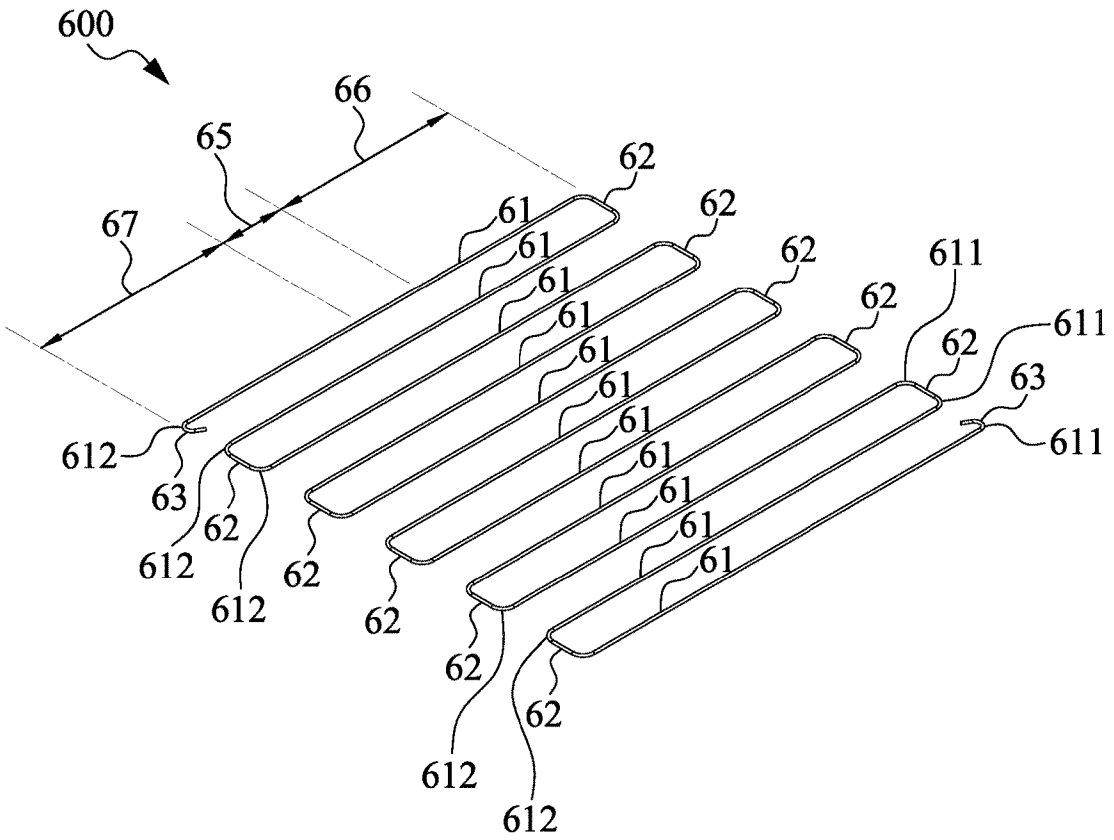
FIG. 5
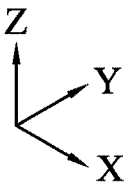

APPARATUS AND METHOD FOR MANUFACTURING CONTINUOUS STIRRUP

FIELD OF INVENTION

This disclosure is related to an apparatus and method for manufacturing a continuous stirrup.

BACKGROUND

Stirrups are utilized to provide main reinforcement to structural beams. They can prevents buckling of the beam and also enhance stability of reinforced concrete structures during seismic activity, offering protection from flexural and shear failure. A primary source of such shear is compression and tension from transverse and vertical force. The tension is contained by stirrups which can hold a cracked surface of the beam together.

A conventional stirrup is planar, made from a single rebar piece. When constructing a rebar cage, multiple stirrups are welded to or tied to the main bars of the rebar cage. However, this is a labor-intensive and time-consuming technique. In addition, since the stirrups are separate from each other and manually welded or tied, it is difficult to precisely control spacing between adjacent stirrups, which can adversely affect structural strength. Thus, what is needed is an apparatus and method for manufacturing a continuous stirrup that can save time and labor accordingly.

SUMMARY OF INVENTION

To solve the problem set forth, an embodiment of the invention provides an apparatus and method for manufacturing a continuous stirrup, resulting in a number of stirrups consecutively connected in an efficient manner, reducing manpower and time required to fix the stirrups to the main bar, while maintaining regular spacing between adjacent stirrups to reinforce structural strength of the rebar cage.

According to some embodiments, the apparatus and method for manufacturing a continuous stirrup is configured to process rebar having planar structure. The planar structure is wave-shaped and includes a number of first segments substantially arranged parallel along a transverse orientation, and a number of second segments each extending along the transverse orientation and alternatively connecting ends of adjacent first segments. The planar structure has a first end and a second end opposite to the first end along a longitudinal orientation, wherein the planar structure is defined as a first lateral region proximate to the first end, a second lateral region proximate to the second end, and an intermediate region between the first lateral region and the second lateral region.

In one embodiment, the method for bending continuous stirrup includes providing a jig on a platform, the jig including an elongated body and a plurality of positioning members arranged on the elongated body along the transverse orientation, placing the planar structure on the platform to abut the first segments of the planar structure against the positioning member and extend the first lateral region from a front edge of the platform; providing an elongated mold that extends along the transverse orientation in such a manner that the elongated mold is able to abut against at least a portion of the first lateral region of the planar structure, impelling the elongated mold to abut against the first lateral region so that the first lateral region is bent upward relative to the platform to form an intermediate structure from the planar structure, flipping the intermediate structure to abut bent portions of the intermediate structure against the elongated body and the positioning members and extend the second lateral region from the front edge of the platform, and impelling the elongated mold to abut against the second lateral region so that the second lateral region is bent upward relative to the platform.

In another embodiment, the method for bending a continuous stirrup includes providing a platform which comprises a first groove and a second groove formed therein, wherein the first groove and the second groove are substantially parallel and extend along the transverse orientation, and the second groove is located between the first groove and a front edge of the platform, fixing a plurality of first positioning members in the first groove of the platform, placing the planar structure on the platform to abut the first segments of the planar structure against the first positioning members and extend the first lateral region from a front edge of the platform, providing an elongated mold that extends along the transverse orientation in such a manner that the elongated mold is able to abut against at least a portion of the first lateral region of the planar structure, impelling the elongated mold to abut against the first lateral region so that the first lateral region is bent upward relative to the platform to form an intermediate structure from the planar structure, fixing a plurality of second positioning members in the second groove of the platform, flipping the intermediate structure to abut bent portions of the intermediate structure against the second positioning members and extend the second lateral region from the front edge of the platform, and impelling the elongated mold to abut against the second lateral region so that the second lateral region is bent upward relative to the platform.

In one embodiment, the continuous stirrup manufacturing apparatus includes a platform, a jig, an elongated mold, and a number of bending members. The jig includes an elongated body and a number of positioning members. The elongated body extends parallel to the transverse orientation slidable on the platform along a longitudinal orientation. The positioning members are disposed on the elongated body and configured to abut against the first segments of the rebar. The elongated mold is disposed adjacent to the front edge of the platform and movable relative to the platform so as to abut against the first segments extending from the front edge of the platform and bend upwards relative to the first segments. The bending members are arranged along the transverse orientation and spaced apart by a predetermined distance, adjacent and substantially parallel to the elongated mold.

In another embodiment, the continuous stirrup manufacturing apparatus includes a platform, a number of first positioning members, an elongated mold, and a number of bending members. The platform has a front edge and a first groove extending parallel thereto. The first positioning members are arranged along the first groove and configured to abut against and position the first segments of the rebar. The elongated mold is positioned adjacent to the front edge of the platform and movable relative to the platform so as to abut against the first segments extending from the front edge of the platform and bend upwards relative to the first segments. The bending members are arranged along the transverse orientation and spaced apart from each by a predetermined distance, the bending members being adjacent and substantially parallel to the elongated mold.

BRIEF DESCRIPTION OF THE DRAWINGS

FIG. 5 is a schematic view of a rebar after it is bent to have a planar structure, in accordance with one embodiment of the invention.

DETAILED DESCRIPTION

To facilitate the review of the technical features, contents, advantages, and achievable effects of the present invention, the embodiments together with the accompanying drawings are described in detail as follows. However, the drawings are used only for the purpose of indicating and supporting the specification, which is not necessarily the real proportion and precise configuration after the implementation of the present invention. Therefore, the relations of the proportion and configuration of the accompanying drawings should not be interpreted to limit the actual scope of implementation of the present invention.

The term "a" or "an" as used herein to describe the element and ingredient of the present invention may mean one or more. The term is used only for convenience and providing the basic concepts of the present invention. Furthermore, unless otherwise required by context, singular terms include pluralities and plural terms include the singular. When used in conjunction with the word "comprising" in a claim, the term "a" or "an" may mean one or more than one. In addition, the term "or" as used herein may mean "and/or."

Spatially relative terms, such as "above," "below," "upward," "left," "right," "downward," "lower," "main body," "base plate," "vertical," "horizontal," "side," "higher," "lower portion," "upper portion," "above," "underneath," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation.

Figure 1:
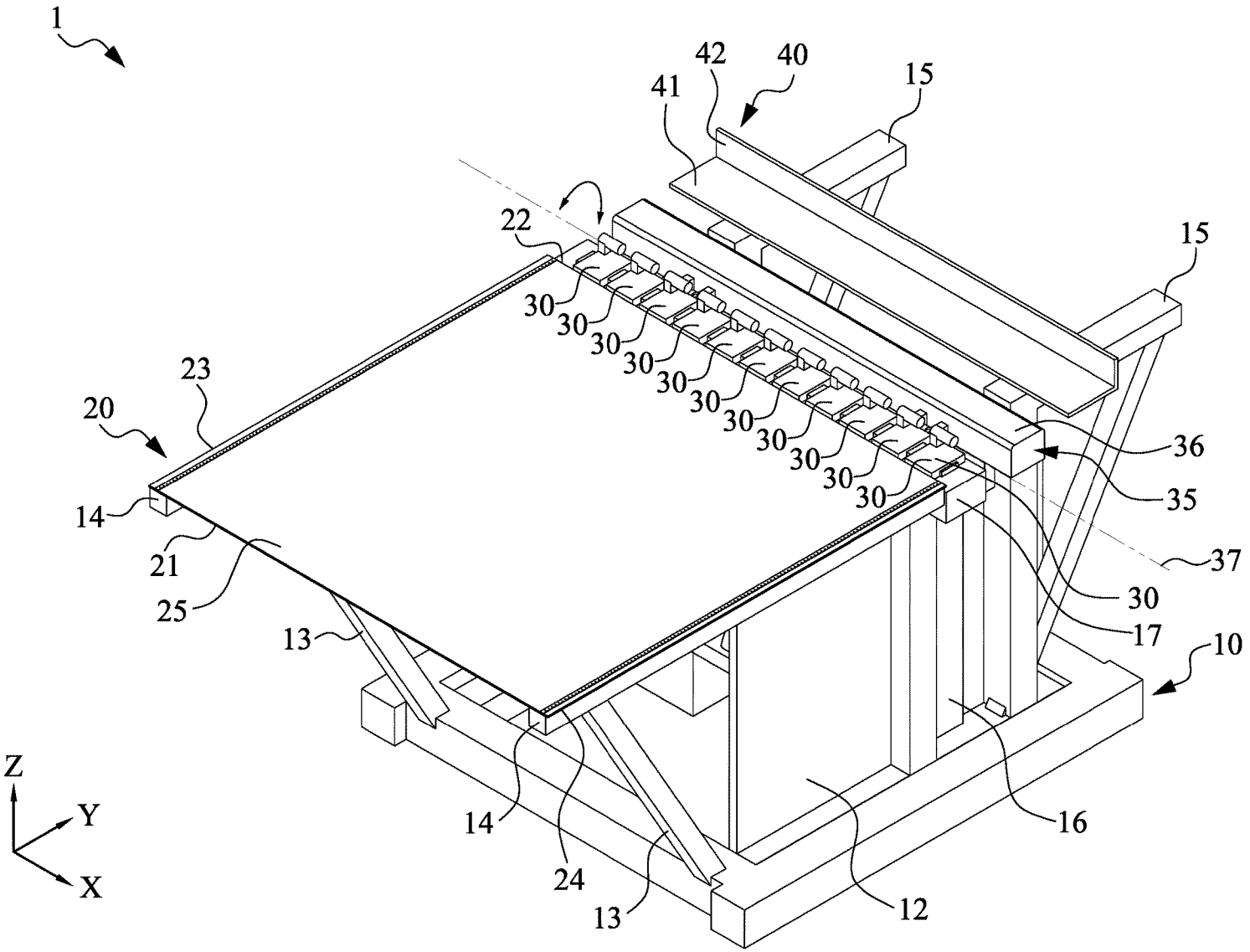
FIG. 1 is a schematic view of a continuous stirrup manufacturing apparatus, in accordance with one embodiment of the invention.

A coordinate having an—X axis, a Y-axis, and a Z-axis is presented in the figures of the present application for describing the structures in the present disclosure. FIG. 1 is a schematic view of a continuous stirrup manufacturing apparatus 1, in accordance with one embodiment of the invention. As shown in FIG. 1, the continuous stirrup manufacturing apparatus 1 includes a base 10, two first supporting plates 12 (only one first supporting plate 12 is shown in FIG. 1, and the other first supporting plate 12 is not shown), two rear supporting frames 13, two upper supporting frames 14, two front supporting frames 15, two second supporting plates 16 (only one second supporting plates 16 is shown in FIG. 1, and the other second supporting plates 16 is not shown), a mounting table 17, a platform 20, a number of bending members 30, an elongated mold, and a size-determining member 40.

The two first supporting plates 12 are disposed at opposing sides of the base 10 along a transverse orientation (X-axis) and extends to a preset height away from the base 10 to support the two upper supporting frames 14 positioned above. The two second supporting plates 16 are distant from the two first supporting plates 12 along the longitudinal orientation (Y-axis.) The two second supporting plates 16 are disposed at opposing sides of the base 10 along the transverse orientation (X-axis) and extend to a preset height away from the base 10 to support the mounting table 17 positioned above. In another embodiment, the first supporting plate 12 and the second supporting plate 16 positioned at the same side of the base 10 are integrally formed to support the upper supporting frame 14 and the mounting table 17. Alternatively, opposing sides of the base 10 can each include more than three supporting plates.

Two ends of the two rear supporting frames 13 are obliquely connected to the base 10 and the two upper supporting frames 14, so as to enhance the structural stability of the two upper supporting frames 14. Overall, the two upper supporting frames 14 are securely supported by the two first supporting plates 12 and the two rear supporting frames 13, and one end of each of the two upper supporting frames 14 is disposed adjacent to the mounting table 17 and extends away from the mounting table 17 along the longitudinal orientation (Y-axis.)

The platform 20 is configured to support the rebar of the continuous stirrup during manufacture of the continuous stirrup. In some embodiments, the platform 20 includes a rectangular plate structure and includes a rear edge 21, a front edge 22 and two lateral edges 23 and 24. The rear edge 21 is opposite to the front edge 22. The two lateral edges 23 and 24 are each connected between the rear edge 21 and the front edge 22 and are opposite to each other. In some embodiments, the platform 20 is disposed on the upper supporting frame 14, wherein the front edge 22 of the platform 20 is disposed adjacent to the mounting table 17, and the two lateral edges 23 and 24 are respectively disposed adjacent to the two upper supporting frame 14. In some embodiments, a distance between the two lateral edges 23 and 24 of the platform 20 exceeds a distance between the two upper supporting frames 14. Therefore, after the platform 20 is disposed on the two upper supporting frames 14, the two lateral edges 23 and 24 of the platform 20 protrude outward from the upper two upper supporting frames 14 along the transverse orientation (X-axis) (i.e., the lateral edges 23 and 24 are spaced apart from upper supporting frame 14.)

In some embodiments, as shown in FIG. 1, a number of bending members 30 are arranged on the mounting table 17 and spaced apart from each other by a predetermined distance along the transverse orientation (X-axis.) The bending members 30 are disposed immediately between the front edge 22 of the platform 20 and the elongated mold 35. A number of positioning grooves corresponding to the shape of the bending member 30 may be pre-formed on the mounting table 17 such that the bending members 30 can be precisely disposed on predetermined positions on the mounting table 17.

Figure 2:
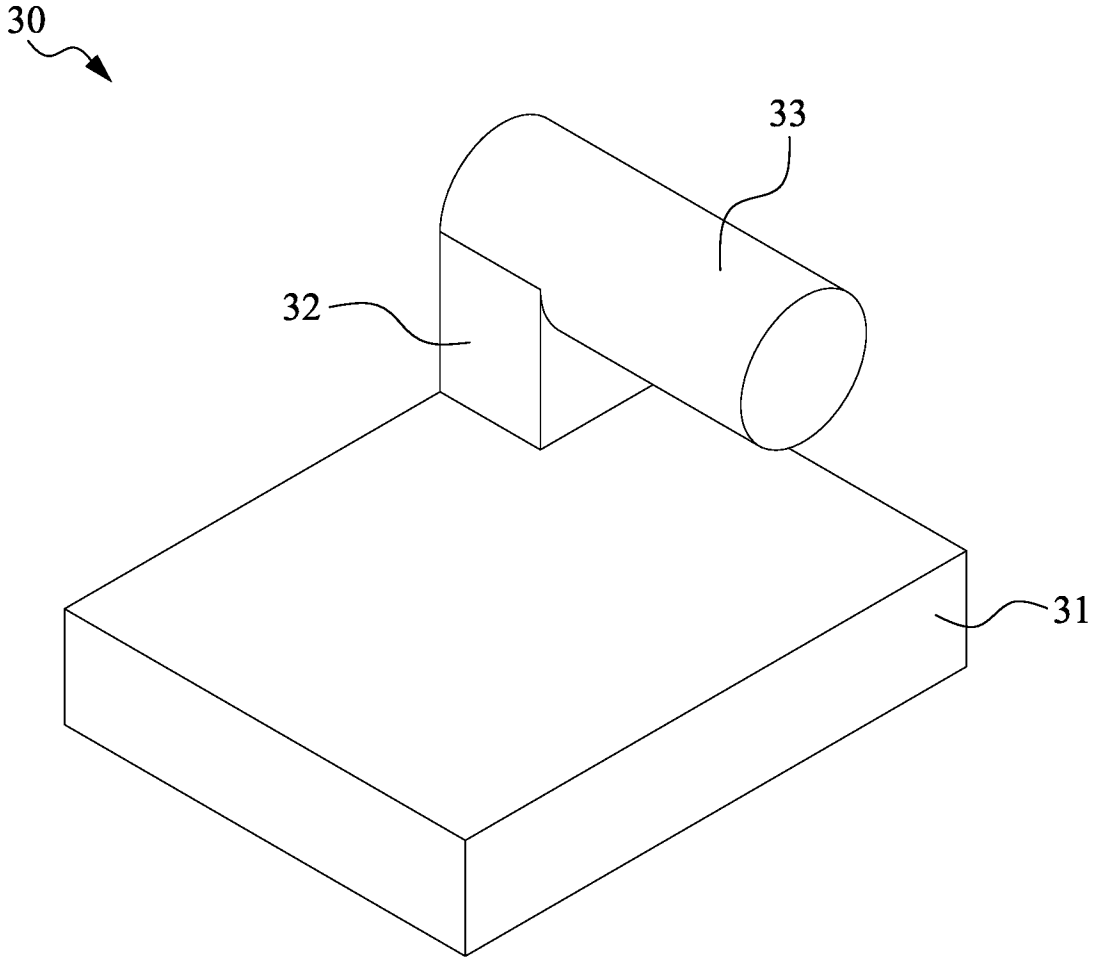
FIG. 2 is a schematic view of a bending structure, in accordance with one embodiment of the invention.

FIG. 2 is a schematic view of the bending member 30, in accordance with one embodiment of the invention. In some embodiments, the bending member 30 includes a rectangular base 31, a connecting portion 32, and a bending structure 33. In some embodiments, as shown in FIG. 2, the connecting portion 32 is disposed at a corner of the base 31, the bending structure 33 extends from the top of the connecting portion 32 parallel to the base 31 (and parallel to the elongated mold 35, as shown in FIG. 1.) The bending structure 33 may have a curved outer surface. However, it should be understood that the embodiments of the instant invention are not limited thereto. In other embodiments, the outer surface of the bending structure 33 may have other shapes, such as triangular, quadrangular, or irregularly polygonal.

With reference to FIG. 1, the elongated mold 35 is configured to bend the rebar a number of turns. In some embodiments, the elongated mold 35 is disposed at a side of the bending member 30 away from the platform 20. The elongated mold 35 extends along the transverse orientation (X-axis) and has substantially the same width as the platform 20 along the transverse orientation (X-axis.) The elongated mold 35 may be driven by an actuating device (such as a hydraulic rod, not shown in figures) so as to rotate around a pivotal axle 37, which is parallel to the transverse orientation (X-axis.) A top surface 36 of the elongated mold 35 may be flat. Before the elongated mold 35 is driven, the top surface 36 and the top surface 25 of the platform 20 are at the same level.

The size-determining member 40 is configured to control a length of the rebar that protrudes from the front edge 22 of the platform 20. In some embodiments, the size-determining member 40 faces the front edge 22 of the platform 20, and the size-determining member 40 and the jig 50 are located at opposing sides of the elongated mold 35. In some embodiments, the size-determining member 40 is disposed on the front supporting frame 15 in a slidable manner relative to the elongated mold 35. In some embodiments, the size-determining member 40 is an L-shaped plate-shaped structure extending along the transverse orientation (X-axis) and includes a supporting portion 41 and a perpendicular limiting portion 42. The support portion 41 may be positioned at the same height as that of the top surface 25 of the platform 20, and the limiting portion 42 located on a side of the support portion 41 away from the elongated mold 35.

Figure 3:
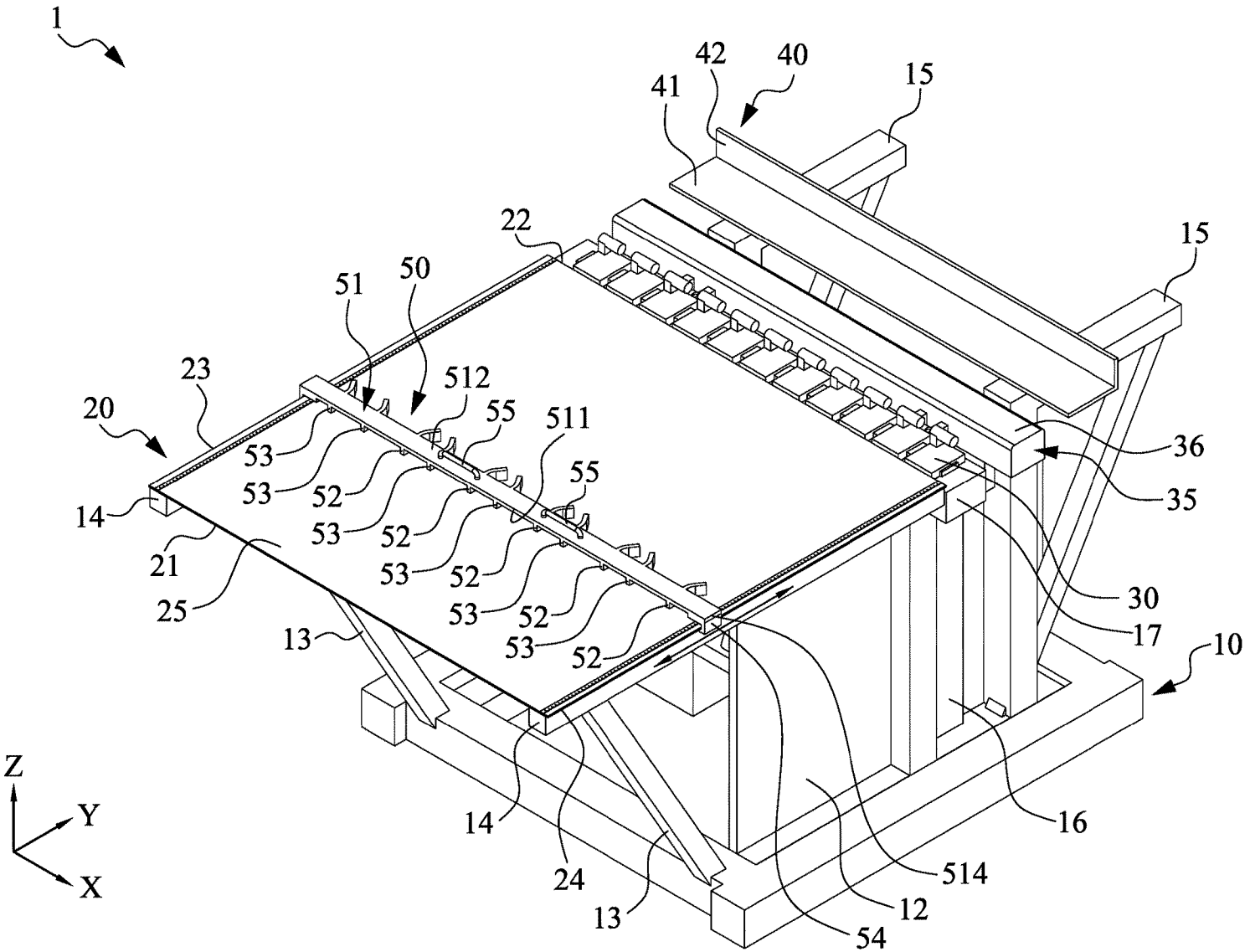
FIG. 3 is a schematic view of a continuous stirrup manufacturing apparatus with a jig, in accordance with one embodiment of the invention.

FIG. 3 is a schematic view of the continuous stirrup manufacturing apparatus 1 with a jig 50, in accordance with one embodiment of the invention. The jig 50 includes an elongated body 51, a number of positioning members, such as a number of first positioning members 52 and a number of second positioning members 53, two hook structures 54, and a number of handles 55. In some embodiments, the elongated body 51 extends parallel to the transverse orientation (X-axis), parallel to the front edge 22 of the platform 20, and may extend along the longitudinal orientation (Y-axis.) In addition, the elongated body 51 is disposed on the platform 20 in a slidable manner along the longitudinal orientation (Y-axis.) The two hook structures 54 are respectively connected to the two ends 514 of the elongated body 51, and are slidably connected to the two lateral edges 23 and 24 of the platform 20. In some embodiments, the handles 55 are disposed on an upper surface 512 of the elongated body 51 allowing the jig 50 to be held and slid relative to the platform 20.

The first positioning members 52 and the second positioning members 53 are configured to fix the position of the rebar during manufacture of the continuous stirrup. In some embodiments, the first positioning members 52 and the second positioning members 53 are arranged on a lower surface 511 of the elongated body 51 such that the elongated body 51 is disposed above a top surface 25 of the platform 20. That is, the lower surface 511 of the elongated body 51 is separated from the platform 20. In some embodiments, the first positioning member 52 and the second positioning member 53 in each pair correspond to a bending member 30. Under such arrangement, after the rebar is placed on the platform 20, a portion of the rebar that extends along the longitudinal orientation (Y-axis) will simultaneously contact the bending member 30 and one of the first positioning member 52 and the second positioning member 53.

In some embodiments, as shown in FIG. 3, the first positioning member 52 and the second positioning member 53 each have a length along the longitudinal orientation (Y-axis), and the ends of first positioning member 52 and the second positioning member 53 are curved, wherein the first positioning member 52 and the second positioning member 53 are bent in opposite directions to form the curve. Specifically, the first positioning member 52 is bent toward the side edge 24, and the second positioning member 53 is bent toward the side edge 23. In some embodiments, the first positioning member 52 and the second positioning member 53 are alternately arranged on the lower surface 514 of the main body 51. The first positioning members 52 and second positioning member 53 are adjacent and together form a bell-mouth structure. However, it can be understood that the embodiments of the instant invention are not limited thereto, and the arrangements of the first positioning member 52 and the second positioning member 53 can be adjusted according to demand. For example, as shown in FIG. 3, the two positioning members 53 closest to the edge 23, are consecutively arranged on the elongated body 51, so as to impel the rebar away from the side edge 23 during operation.

FIGS. 3-11 show some embodiments of the instant invention in which a method of manufacturing the continuous stirrup using the continuous stirrup manufacturing apparatus 1 is as follows.

As shown in FIG. 3, the method for manufacturing the continuous stirrup includes providing the jig 50 on the platform 20. In some embodiments, after the jig 50 is disposed on the platform 20, the hook structures 54 of the jig 50 connect the two lateral edges 23 and 24 of the platform 20 in a slidable manner, and the first positioning member 52 and the second positioning member 53 of the jig 50 each align with one of the bending members 30 along the longitudinal orientation (Y-axis.)

Figure 4:
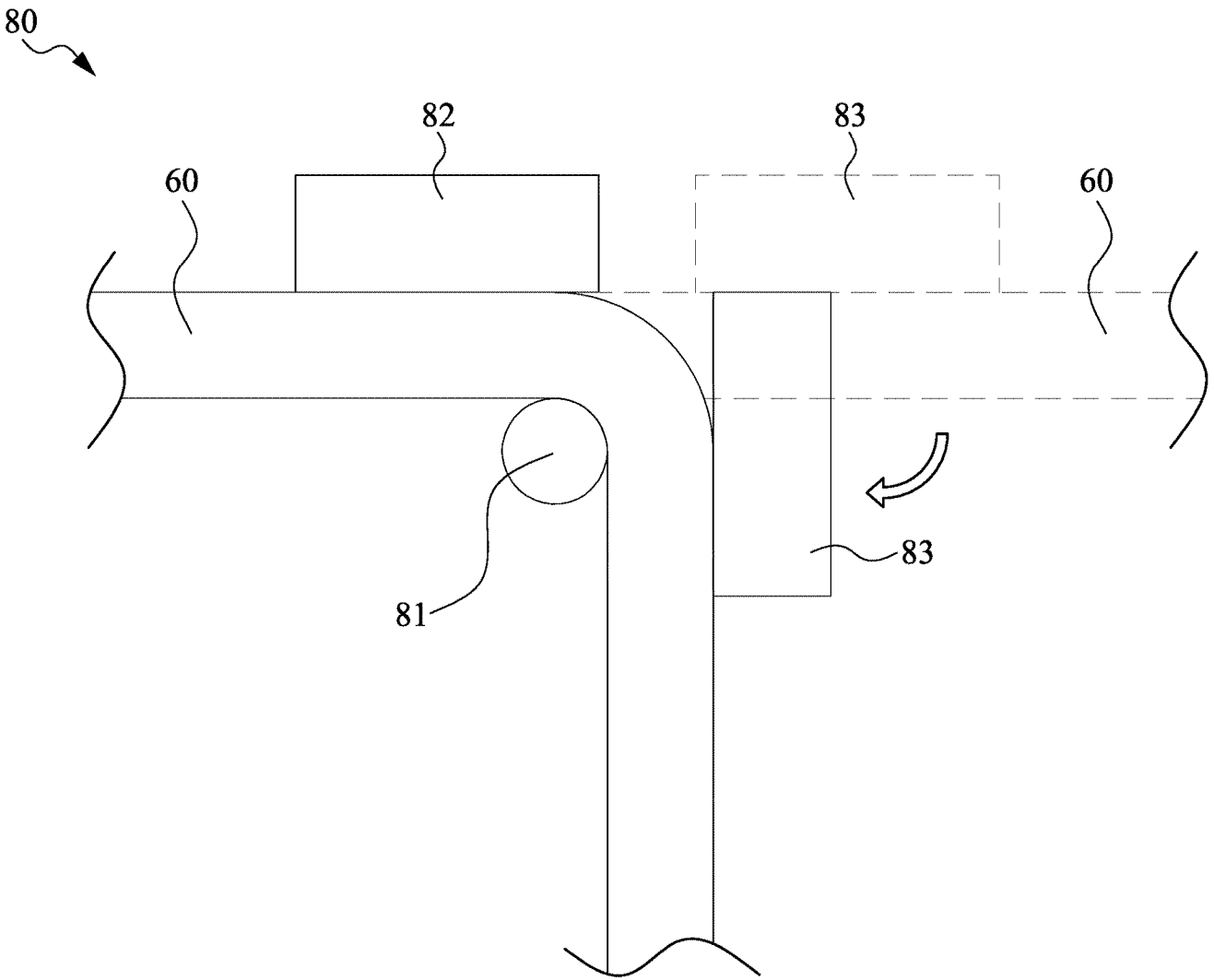
FIG. 4 is schematic view of a method for forming a continuous stirrup, in accordance with one embodiment of the invention.

In some embodiments, as shown in FIG. 4, the rebar 60 is processed by a bending apparatus 80 to form a wave-shaped planar structure before it is used to make the continuous stirrup. In some embodiments, the bending apparatus 80 includes a bending structure 81, a stationary block 82 and a movable block 83. The stationary block 82 and the movable block 83 are arranged in a straight line, wherein the movable block 83 can rotate in the direction of the arrow as shown in FIG. 4. The bending structure 81 is disposed facing one end of the stationary block 82 adjacent to the movable block 83 and has a curved surface. The steps of forming the wave-shaped planar structure include feeding the rebar into the bending apparatus 80 and abutting the rebar 60 against the stationary block 82 and the movable block 83 at the same time. Next, the movable block 83 is rotated in the direction of the arrow shown in FIG. 4, and the rebar 60 is bent by the bending structure 81. These steps may be repeated several times to form the planar structure 600 as shown in FIG. 5.

In some embodiments, the planar structure 600 includes a number of first segments 61, a number of second segments 62, and two end hooks 63. The first segments 61 are disposed along the transverse orientation (X-axis), are parallel along a longitudinal orientation (Y-axis), and each have a first end 611 and a second end 612 opposite thereto. The second segments 62 extend along the transverse orientation (X-axis) and each connect two adjacent first segments 61. The two end hooks 63 are respectively formed from the outermost first segment 61. The two end hooks 63 are formed by bending the outermost first segment 61. For ease of description, in the following description, a region of the planar structure 600 adjacent to the first end 611 of the first segment 61 is referred to as first lateral region 66, a region of the planar structure 600 adjacent to the second end 612 is referred to as second lateral region 66, and a region located between the first lateral region 66 and the second lateral region 67 is referred to as intermediate region 65. The lengths of the first lateral region 66 and the second lateral region 67 along the longitudinal orientation (Y-axis) may be the same, and the size can be determined according to design requirements.

Figure 6:
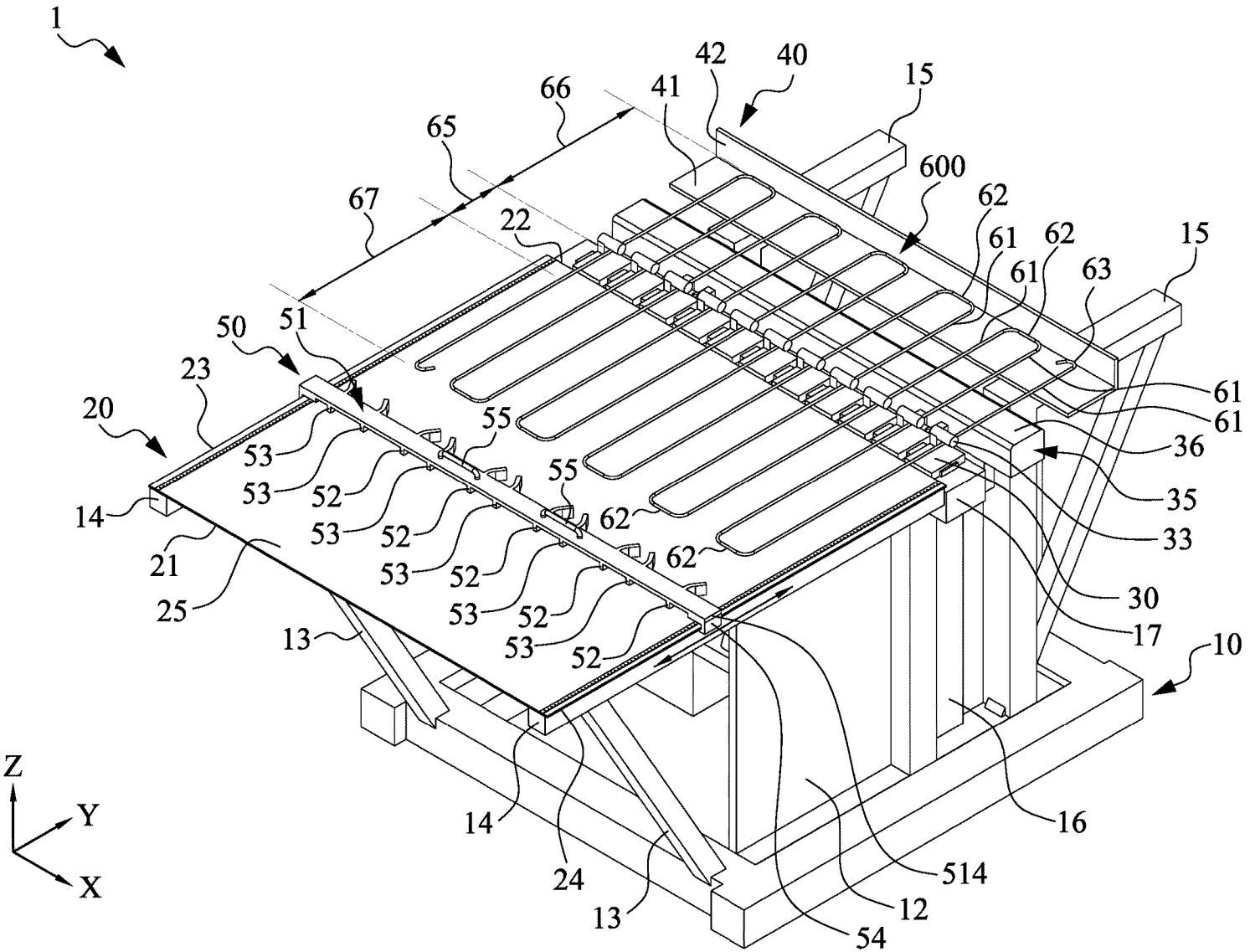
FIG. 6 is a schematic view of a first stage of a method for forming a continuous stirrup, in accordance with a first embodiment of the invention.

As shown in FIG. 6, the method for manufacturing the continuous stirrup further includes placing the planar structure 600 on the platform 20 such that the first lateral region 66 protrudes from the front edge 22 of the platform 20, and the second segments 62 in the first lateral region 66 abut against the limiting portion 42 of the size-determining member 40. With the size-determining member 40, each first segment 61 at the intersection of the first lateral region 66 and the intermediate region 65 will be positioned below the corresponding bending structure 33. In some embodiments, distance between the size-determining member 40 and the elongated mold 35 can be adjusted according to the size of the planar structure 600.

Figure 7:
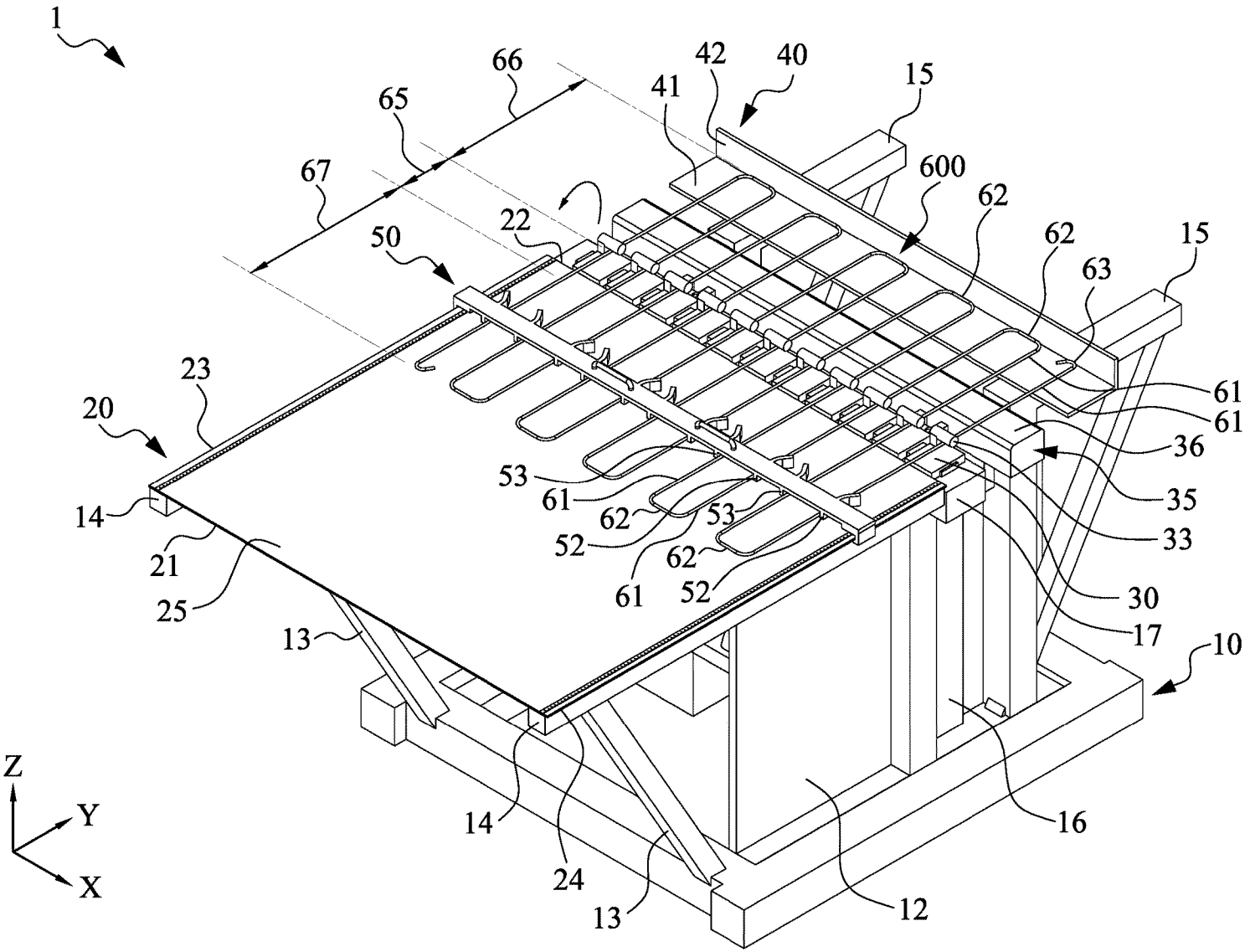
FIG. 7 is a schematic view of a second stage of a method for forming a continuous stirrup, in accordance with the first embodiment of the invention.

As shown in FIG. 7, the method for manufacturing the continuous stirrup further includes moving the jig 50 such that the positioning members of the jig 50, such as first positioning member 52 and second positioning member 53, each abut against the first segment 61 of the planar structure 600. In some embodiments, the jig 50 is slidable along the longitudinal orientation (Y-axis) from a starting position (FIG. 6) to an operating position (FIG. 7.) During such sliding of the jig 50, the second segments 62 in the second lateral region 67 are each guided by the bell-mouth structures formed by the first positioning members 52 and the second positioning members 53 through the jig 50. After the second segments 62 in the second lateral region 67 pass through the jig 50, the adjacent first positioning member 52 and the second positioning member 53 respectively abut against the two first segments 61 connected by the corresponding second segment 62. In some embodiments, the first positioning member 52 and the second positioning member 53 each have curved ends. Specifically, both ends of the first positioning member 52 and the second positioning member 53 extend away from the first segments 61 against which they abut to form the curves. After the second segment 62 in the second lateral region 67 passes the jig 50, two of the first segments 61 connected by the corresponding second segment 62 respectively abut against the adjacent first positioning member 52 and the second positioning member 53 respectively.

In addition, as shown in FIG. 7, the method for manufacturing the continuous stirrup further includes providing an elongated mold 35 along the transverse orientation (X-axis) and abutting the top surface 36 of the elongated mold 35 against at least a portion of the first lateral region 66 of the planar structure 600. In some embodiments, before the first lateral region 66 is bent by the elongated mold 35, the first lateral region 66 is cooperatively supported by the base 31 of the bending member 30 (FIG. 2), the top surface 36 of the elongated mold 35, and the supporting portion 41 of the size-determining member 40.

Figure 8:
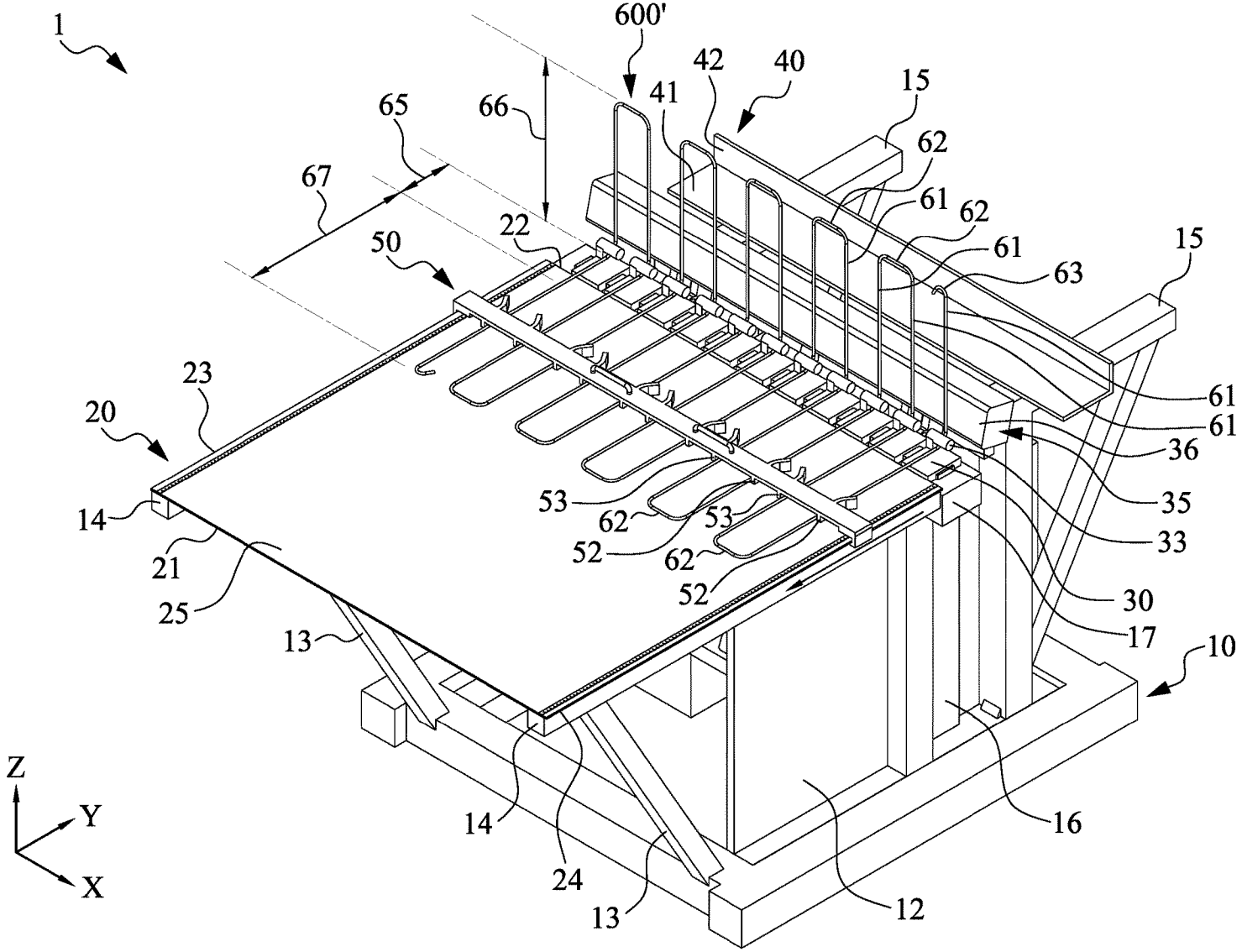
FIG. 8 is a schematic view of a third stage of a method for forming a continuous stirrup, in accordance with the first embodiment of the invention.

As shown in FIG. 8, the method for manufacturing the continuous stirrup further includes impelling the elongated mold 35 to bend the first lateral region 66 upward relative to the platform 20. The planar structure 600 is thus reformed into an intermediate structure 600'. In some embodiments, since the position of the first segments 61 of the planar structure 600 along the transverse orientation (X-axis) is limited by the first positioning members 52 and the second positioning members 53, when the first lateral region 66 is contacted by the elongated mold 35, shifting or skewing of first segments 61 of the planar structure 600 can be prevented. Therefore, the bent first segments 61 remain substantially parallel along the longitudinal orientation (Y-axis.) After the bending of the first lateral region 66 relative to the intermediate region 65, the jig 50 is detached from the intermediate structure 600', and the intermediate structure 600' is temporarily removed from the continuous stirrup manufacturing apparatus 1.

Figure 9:
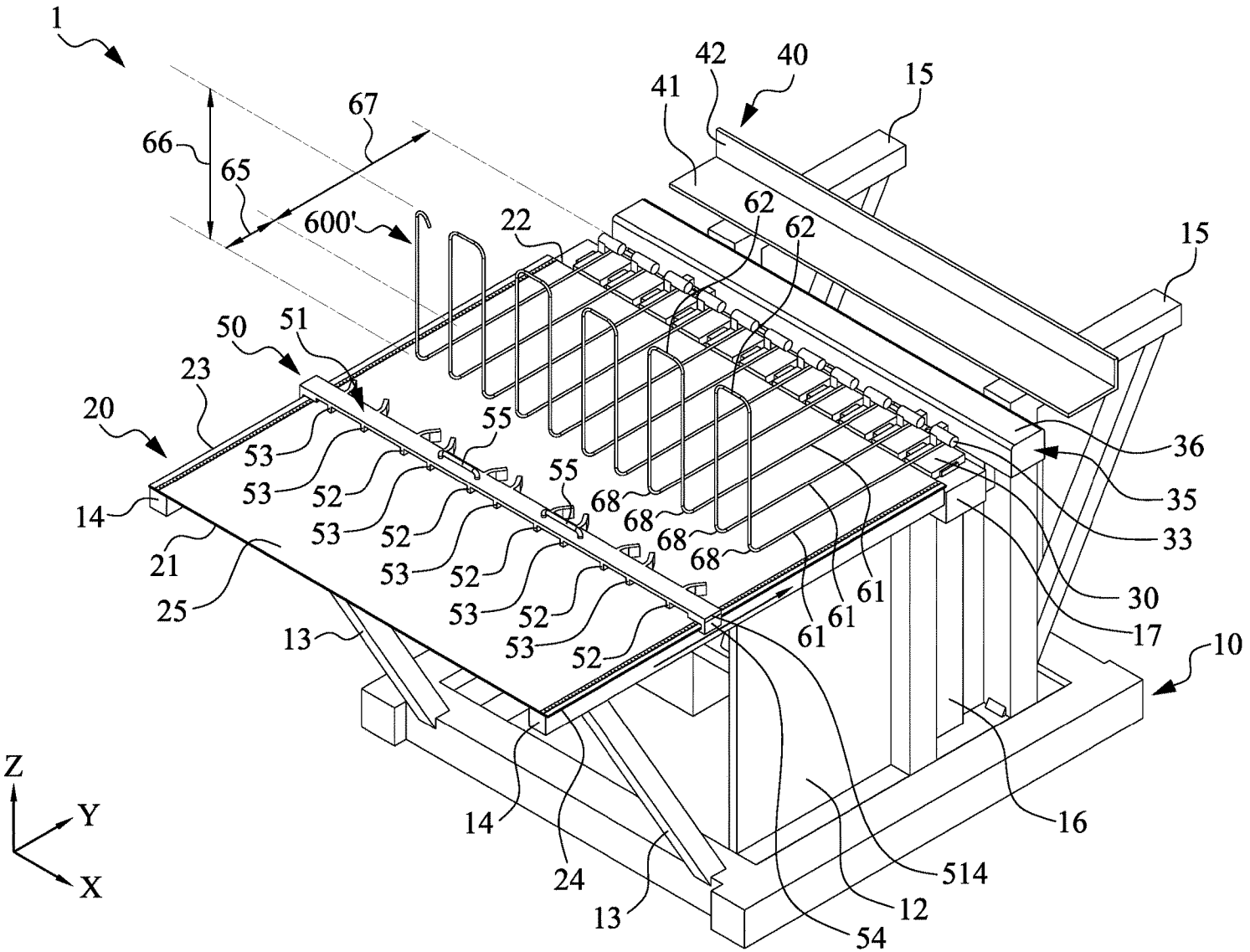
FIG. 9 is a schematic view of a fourth stage of a method for forming a continuous stirrup, in accordance with the first embodiment of the invention.

As shown in FIG. 9, the method for manufacturing the continuous stirrup further includes flipping the intermediate structure 600' and placing it on the platform 20 such that a portion of the second lateral region 67 protrudes from the front edge 22 of the platform 20 and is positioned below the bending structure 33.

Figure 10:
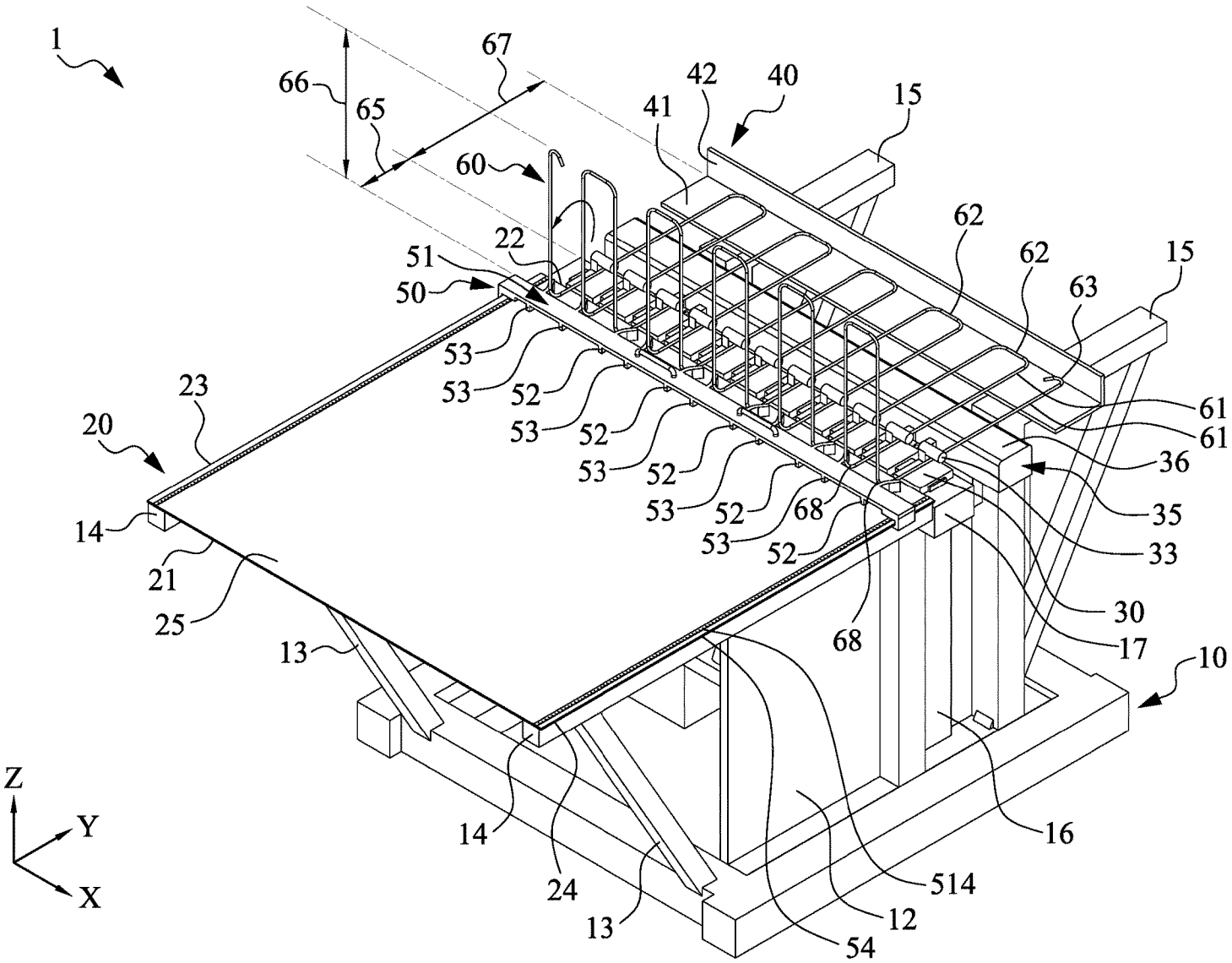
FIG. 10 is a schematic view of a fifth stage of a method for forming a continuous stirrup, in accordance with the first embodiment of the invention.

As shown in FIG. 9, the method for manufacturing the continuous stirrup further includes abutting the elongated body 51 and first positioning member 52 and the second positioning member 53 against bent portions 68 of the intermediate structure 600'. In some embodiments, the jig 50 is slidable along the longitudinal orientation (Y-axis) from a starting position (FIG. 9) to an operating position (FIG. 10.) During such sliding of the jig 50, the bent portions 68 of the intermediate structure 600' are guided by the bell-mouth structures formed by the adjacent first positioning member 52 and the second positioning member 53 to be positioned therebetween. Then, the adjacent first positioning member 52 and the second positioning member 53 each abut against the first segments 61 corresponding to the bent portions 68. The intermediate structure 600' is then impelled by the jig 50 along the longitudinal orientation (Y-axis) until the second segment 62 in the second lateral region 67 abuts against the limiting portion 42 of the size-determining member 40, as shown in FIG. 10. At this point, each first segment 61 at the intersection of the second lateral region 67 and the intermediate region 65 is positioned below the bending structure 33. In addition, the second lateral region 67 is cooperatively supported by the base 31 (FIG. 2) of the bending member 30, the top surface 36 of the elongated mold 35, and the supporting portion 41 of the size-determining member 40.

Figure 11:
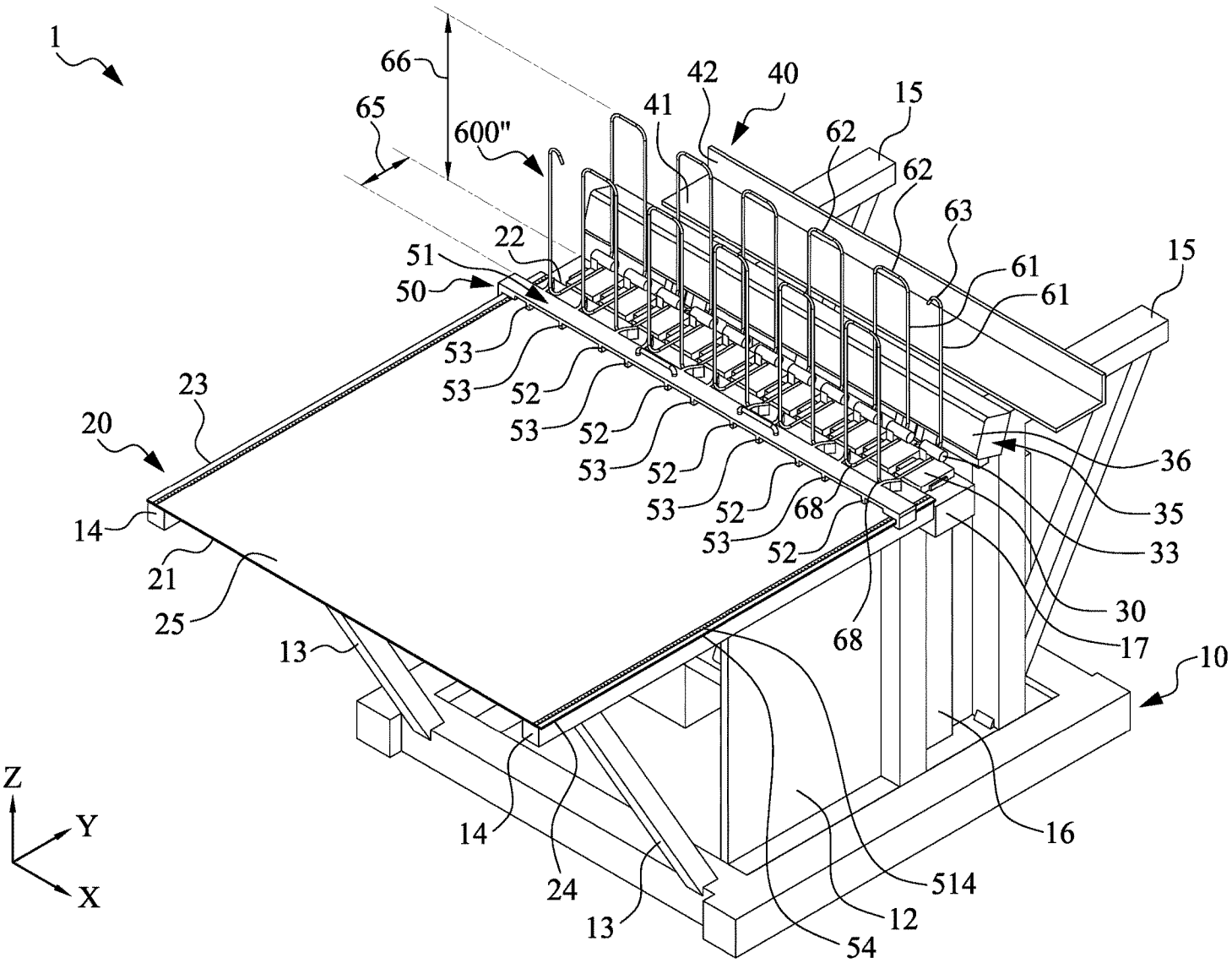
FIG. 11 is a schematic view of a sixth stage of a method for forming a continuous stirrup, in accordance with the first embodiment of the invention.

As shown in FIG. 11, the method for manufacturing the continuous stirrup further includes impelling the elongated mold 35 to bend the second lateral region 67 upward relative to the platform 20 to form the continuous stirrup 600". In some embodiments, since the position of the first segment 61 of the intermediate structure 600' along the transverse orientation (X-axis) is limited by the first positioning member 52 and the second positioning member 53, when the second lateral region 67 is impelled by the elongated mold 35, shifting or skewing of first segments 61 of the intermediate structure 600' can be prevented. Therefore, the bent first segments 61 of the intermediate structure 600' remain substantially parallel along the longitudinal orientation (Y-axis.) In some embodiments, after the second lateral region 67 is bent, the jig 50 is detached from the continuous stirrup, and the continuous stirrup 600" is unloaded from the continuous stirrup manufacturing apparatus 1.

Figure 12:
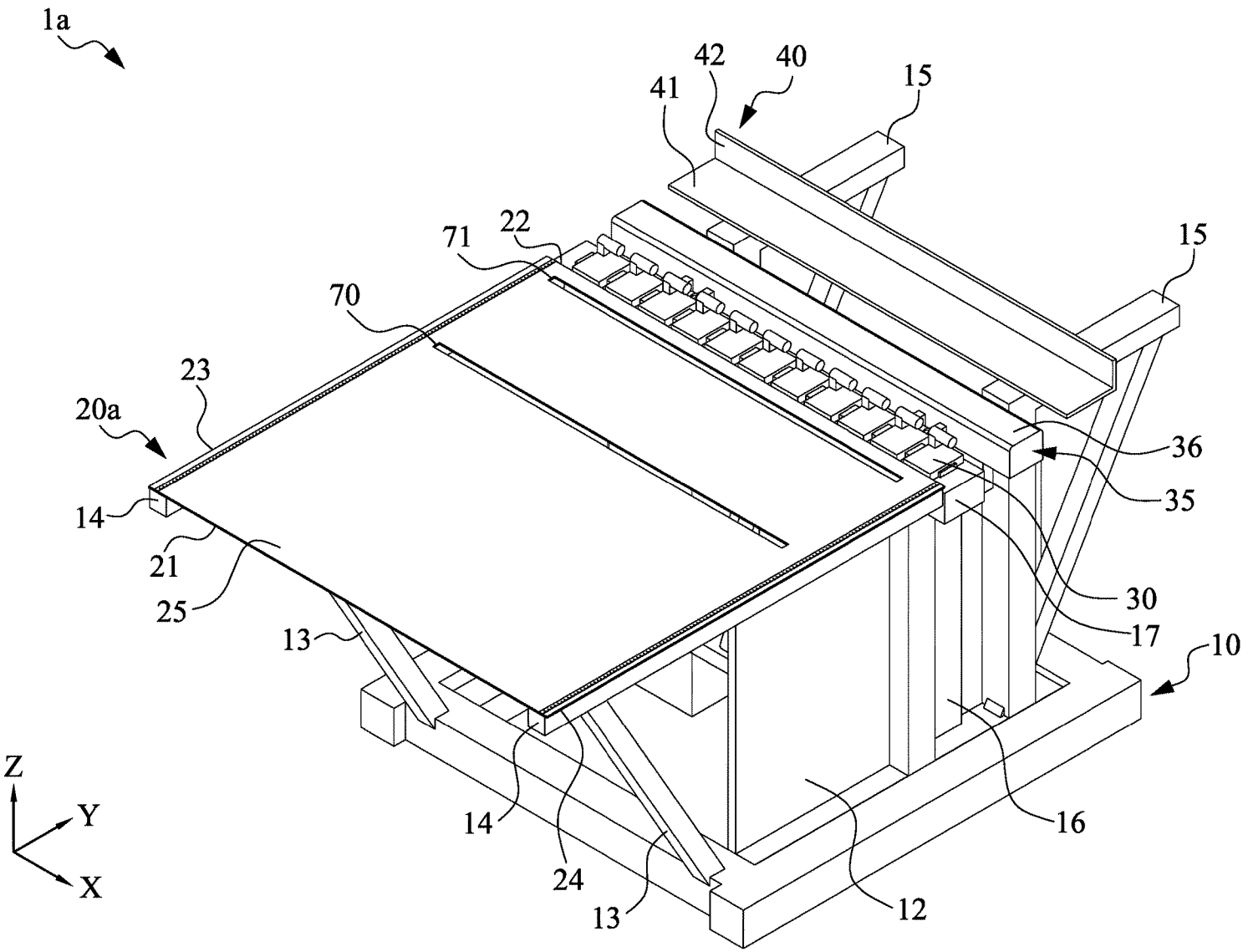
FIG. 12 is a schematic view of a continuous stirrup manufacturing apparatus, in accordance with another embodiment of the invention.

FIG. 12 is a schematic view of a continuous stirrup manufacturing apparatus 1*a*, in accordance with one embodiment of the instant invention. In this embodiment, components the same as those of the continuous stirrup manufacturing apparatus 1 of FIGS. 1-11 are denoted by the same reference numerals, with description of the features of these components not be repeated for brevity. The continuous stirrup manufacturing apparatus 1*a* differs from the previously described continuous stirrup manufacturing apparatus 1 in that platform 20 of the continuous stirrup manufacturing apparatus 1 is replaced by platform 20*a*, and jig 50 of the continuous stirrup manufacturing apparatus 1 is replaced by a plurality of positioning members, such as first positioning member 72 and second positioning member 73 (see FIG. 13.)

In some embodiments, the platform 20*a* is configured to support the planar structure 600 during manufacture of the continuous stirrup. In some embodiments, the platform 20*a* has structures similar to those of the platform 20 shown in FIG. 1, differing therefrom in that platform 20*a* further includes a first groove 70 and a second groove 71, which penetrate the platform 20*a*. The first groove 70 and the second groove 71 each extend along the transverse orientation (X-axis) and are parallel to the front edge 22 of the platform 20*a*, wherein the second groove 71 is located between the first groove 70 and the front edge 22 of the platform 20*a*.

Figure 13:
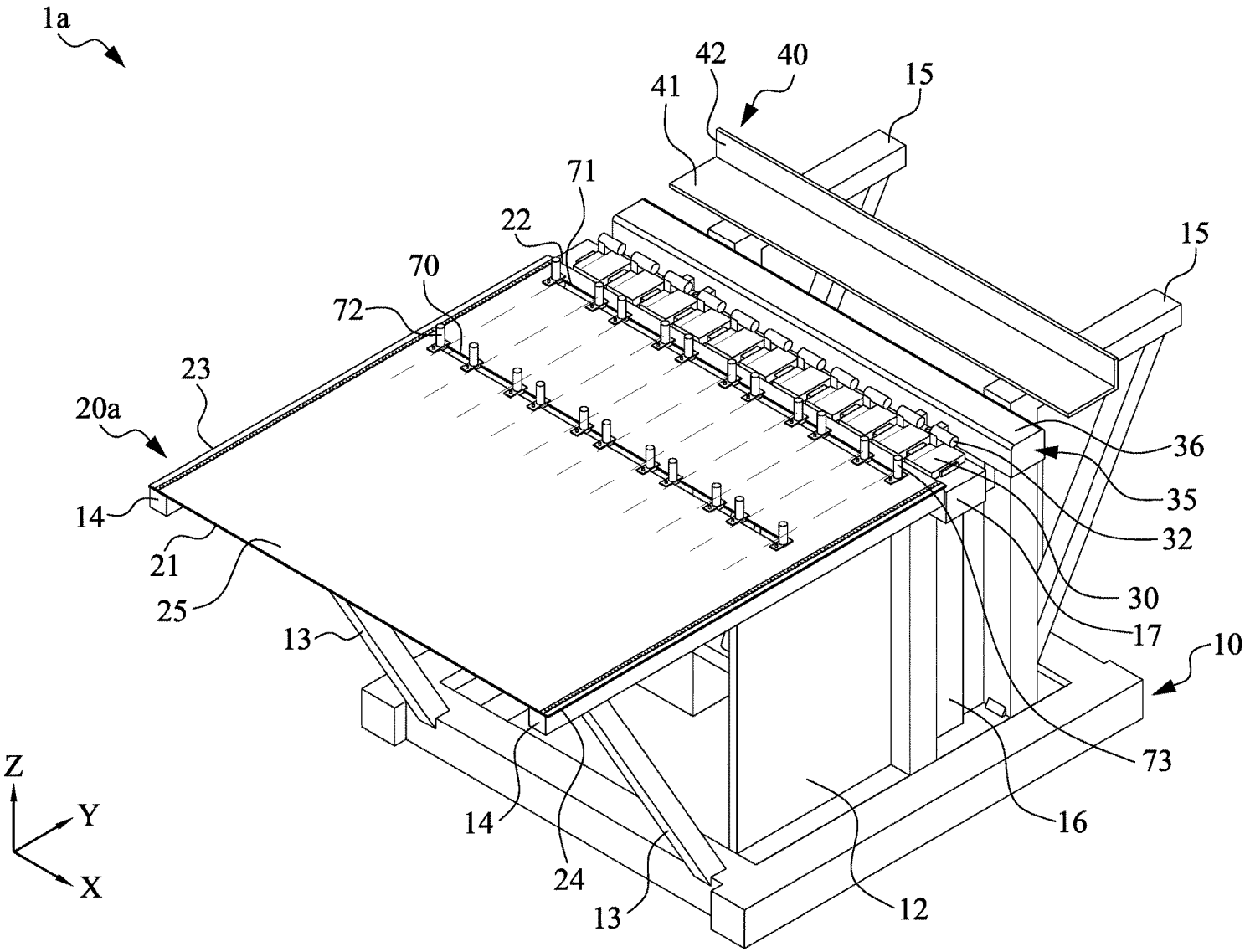
FIG. 13 is a schematic view of a continuous stirrup manufacturing apparatus with positioning members, in accordance with another embodiment of the invention.
Figure 15:
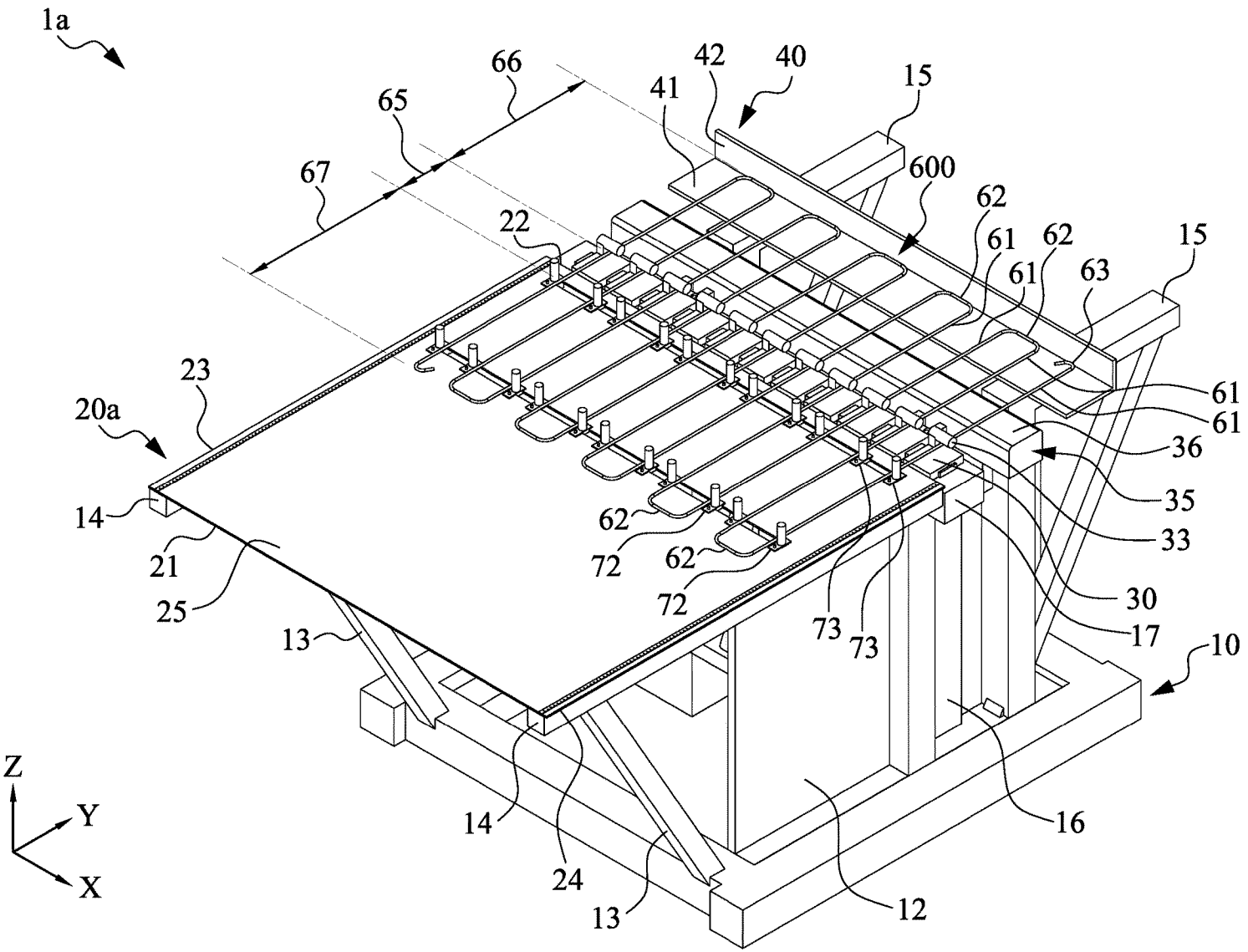
FIG. 15 is a schematic view of a first stage of a method for forming a continuous stirrup, in accordance with a second embodiment of the invention.

FIG. 13 is a schematic view of continuous stirrup manufacturing apparatus 1*a* with the first positioning members 72 and the second positioning members 73, in accordance with one embodiment of the instant invention. In some embodiments, the first positioning members 72 are disposed in the first groove 70 and each align with one of bending members 30 along the longitudinal orientation (Y-axis.) In addition, the second positioning members 73 are disposed in the second groove 71 and each align with one of bending members 30 along the longitudinal orientation (Y-axis.) As shown in FIG. 15, a pair of the first positioning member 72 and the second positioning member 73 that correspond to the same bending member 30 are arranged such that when the planar structure 600 is placed on the platform 20*a*, the positioning member 72 and the second positioning member 73 respectively abut against the opposing left and right sides of the corresponding first segment 61 of the planar structure 600. It should be understood, however, that the embodiments of the instant invention are not limited thereto. In some embodiments, the first groove 70 and the first positioning members 72 may be omitted, with the first segments 61 of the planar structure 600 merely positioned through the second positioning members 73.

Figure 14:
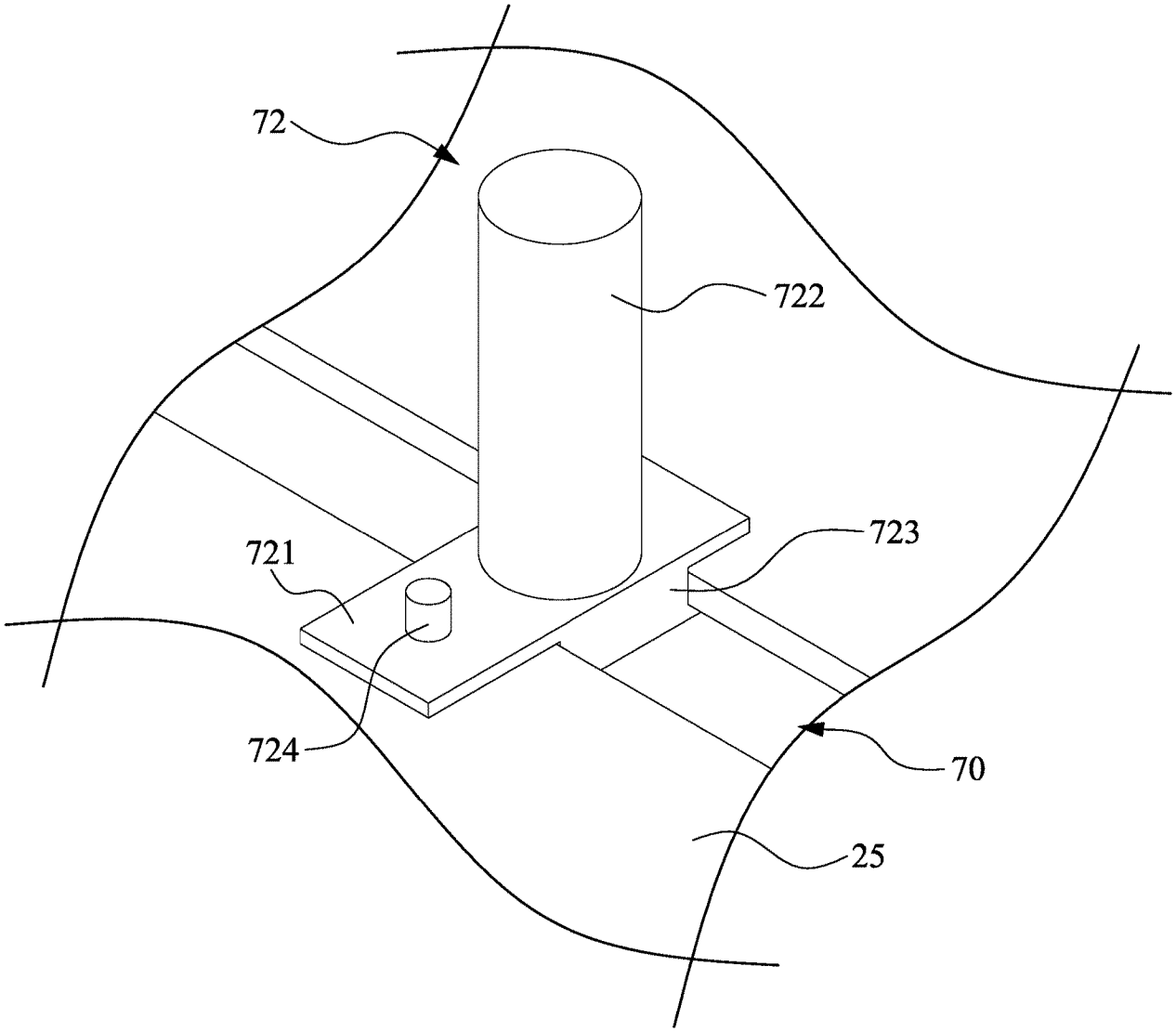
FIG. 14 is a schematic view of a positioning member, in accordance with one embodiment of the invention.

With reference to FIG. 14, in some embodiments, each of the first positioning members 72 includes a base plate 721, a positioning post 722, an extension portion 723, and a fixing member 724. The base plate 721 spans the first groove 70, and is disposed on the top surface 25 through fixing members 724 (e.g., screws or bolts.) The positioning post 722 is disposed above the base plate 721 and has a cylindrical structure. The extension portion 723 is disposed below the base plate 721 and inserted into the first groove 70 such that the first positioning member 72 is positioned in the first groove 70. In some embodiments, the structural features of the second positioning member 73 are the same or similar to those of the first positioning member 72, and therefore detailed descriptions thereof omitted herefrom.

FIGS. 13 and 15-18 show some embodiments of the instant invention in which a method of manufacturing the continuous stirrup using the continuous stirrup manufacturing apparatus 1*a* is as follows.

As shown in FIG. 13, the method for manufacturing the continuous stirrup includes fixing a number of first positioning members 72 in the first groove 70 of the platform 20*a*, and fixing a number of second positioning members 73 in the second groove 71 of the platform 20*a*. In some embodiments, the operation of fixing the second positioning member 73 is omitted.

As shown in FIG. 15, the method for manufacturing the continuous stirrup further includes placing the planar structure 600 on the platform 20*a* such that the first lateral region 66 protrudes from the front edge 22 of the platform 20*a*, and the second segments 62 in the first lateral region 66 abut against the limiting portion 42 of the size-determining member 40. With the size-determining member 40, each of the first segments 61 at the intersection of the first lateral region 66 and the intermediate region 65 are positioned below the corresponding bending structure 33. In addition, when the planar structure 600 is placed on the platform 20*a*, the opposing sides of each of the first segments 61 of the planar structure 600 abut against the corresponding first positioning member 72 and second positioning member 73.

In addition, as shown in FIG. 15, the method for manufacturing the continuous stirrup further includes providing an elongated mold 35 along the transverse orientation (X-axis) and abutting the top surface 36 against at least a portion of the first lateral region 66 of the planar structure 66. In some embodiments, before the first lateral region 66 is bent, the first lateral region 66 is cooperatively supported by the base 31 of the bending member 30 (FIG. 2), the top surface 36 of the elongated mold 35, and the supporting portion 41 of the size-determining member 40.

Figure 16:
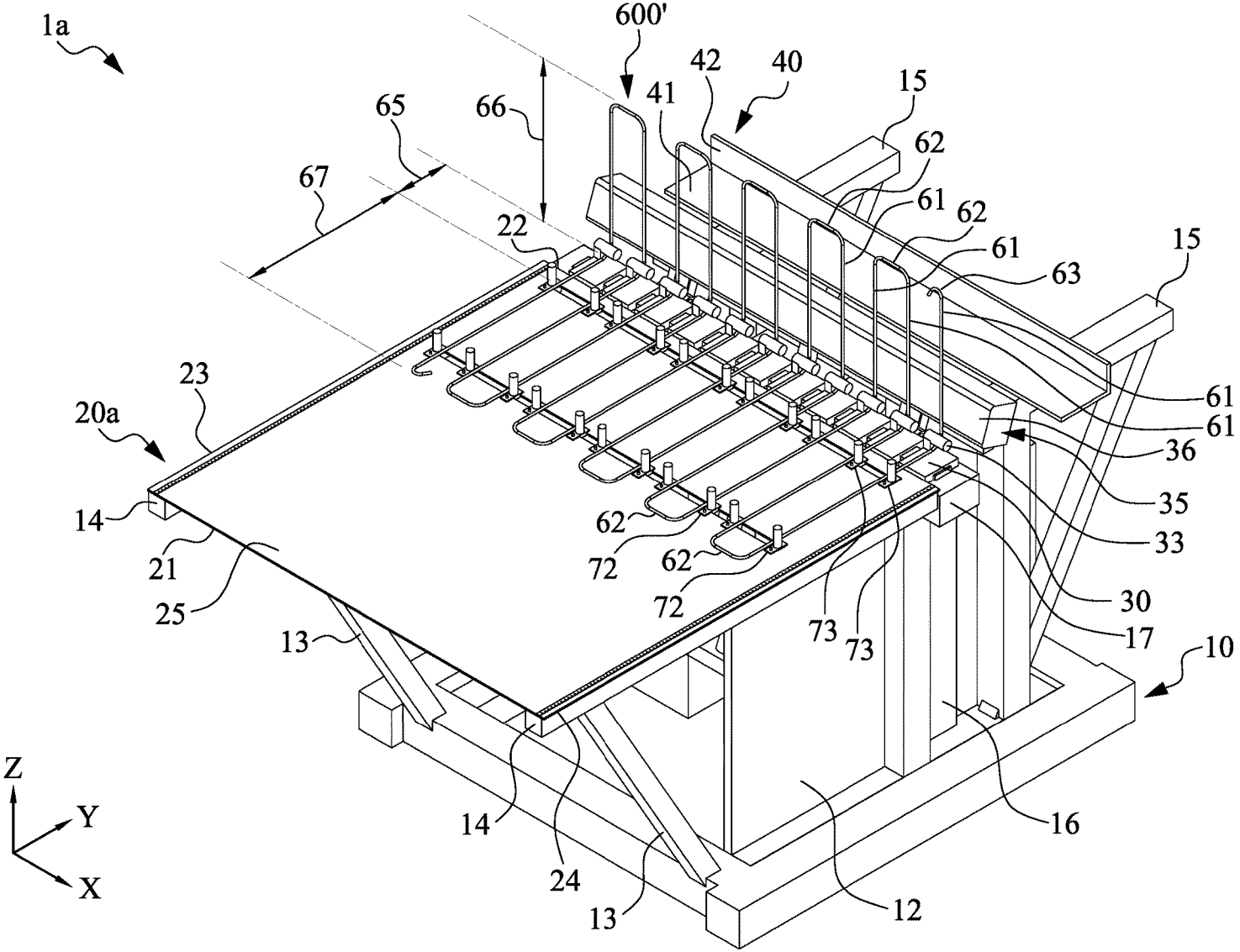
FIG. 16 is a schematic view of a second stage of a method for forming a continuous stirrup, in accordance with the second embodiment of the invention.

As shown in FIG. 16, the method for manufacturing the continuous stirrup further includes impelling the elongated mold 35 to bend the first lateral region 66 upwards relative to the platform 20*a*. The planar structure 600 is thus transformed into an intermediate structure 600'. In some embodiments, since the position of the first segments 61 of the planar structure 600 along the transverse orientation (X-axis) is restricted by the first positioning member 72 and the second positioning member 73, when the first lateral region 66 is impelled by the elongated mold 35, the first segments 61 of the planar structure 600 do not shift. Therefore, the bent first segments 61 remain substantially parallel along the longitudinal orientation (Y-axis). After the first lateral region 66 is bent relative to the intermediate region 65, the intermediate structure 600' is temporarily removed from the continuous stirrup manufacturing apparatus 1*a*.

Figure 17:
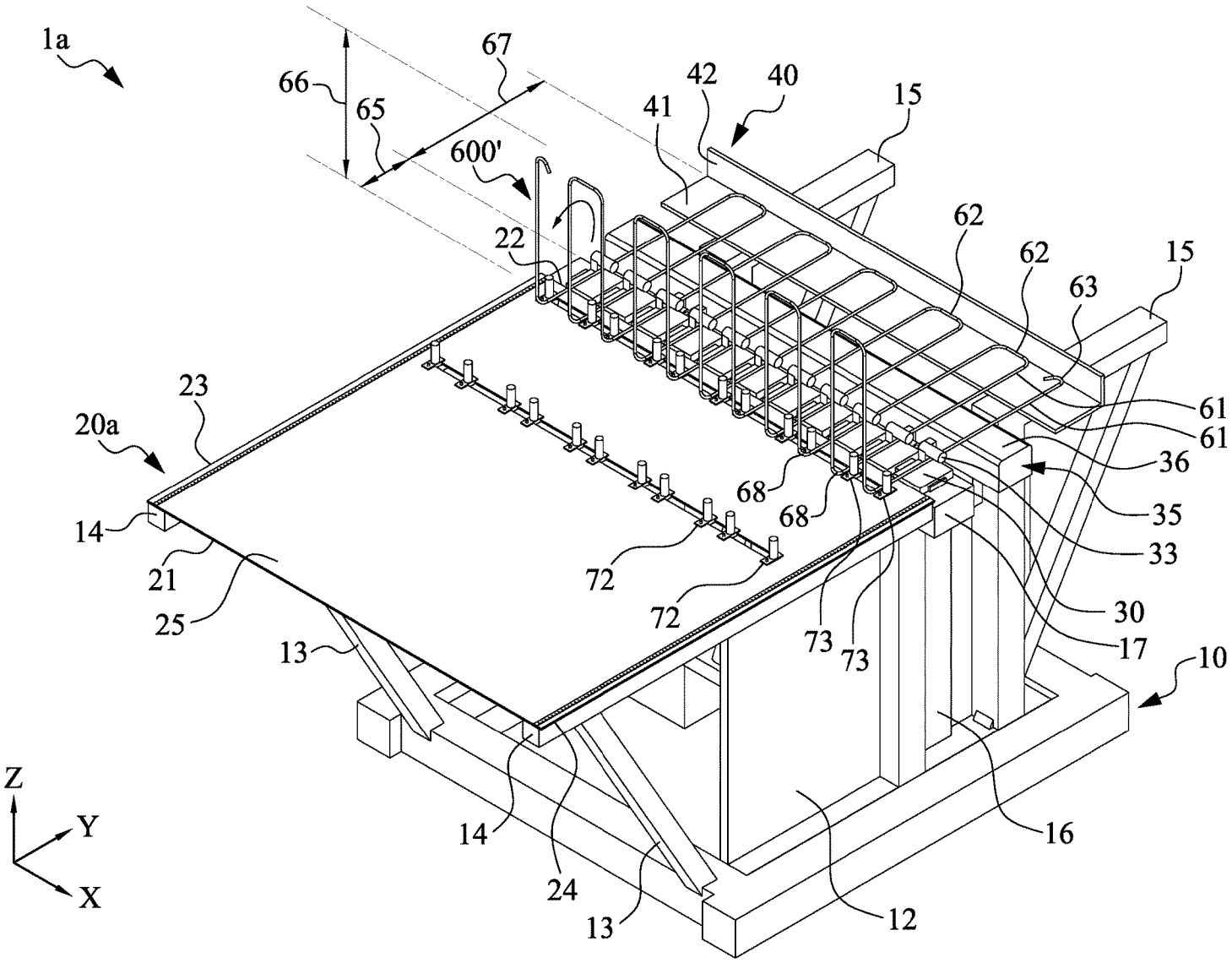
FIG. 17 is a schematic view of a third stage of a method for forming a continuous stirrup, in accordance with the second embodiment of the invention.

As shown in FIG. 17, the method for manufacturing the continuous stirrup further includes flipping the intermediate structure 600' and placing it on the platform 20*a* such that a portion of the second lateral region 67 protrudes from the front edge 22 of the platform 20*a* and is positioned below the bending structure 33. In some embodiments, as shown in FIG. 17, the intermediate structure 600' is flipped and placed on the platform 20*a*, and the second lateral region 67 of the intermediate structure 600' is cooperatively supported by the base 31 (FIG. 2) of the bending member 30, the top surface 36 of the elongated mold 35, and the supporting portion 41 of the size-determining member 40. In some embodiments, as shown in FIG. 17, after the intermediate structure 600' is placed on the platform 20*a*, the bent portions 68 of the intermediate structure 600' abut against the second positioning members 73 and are separated from first positioning members 72.

Figure 18:
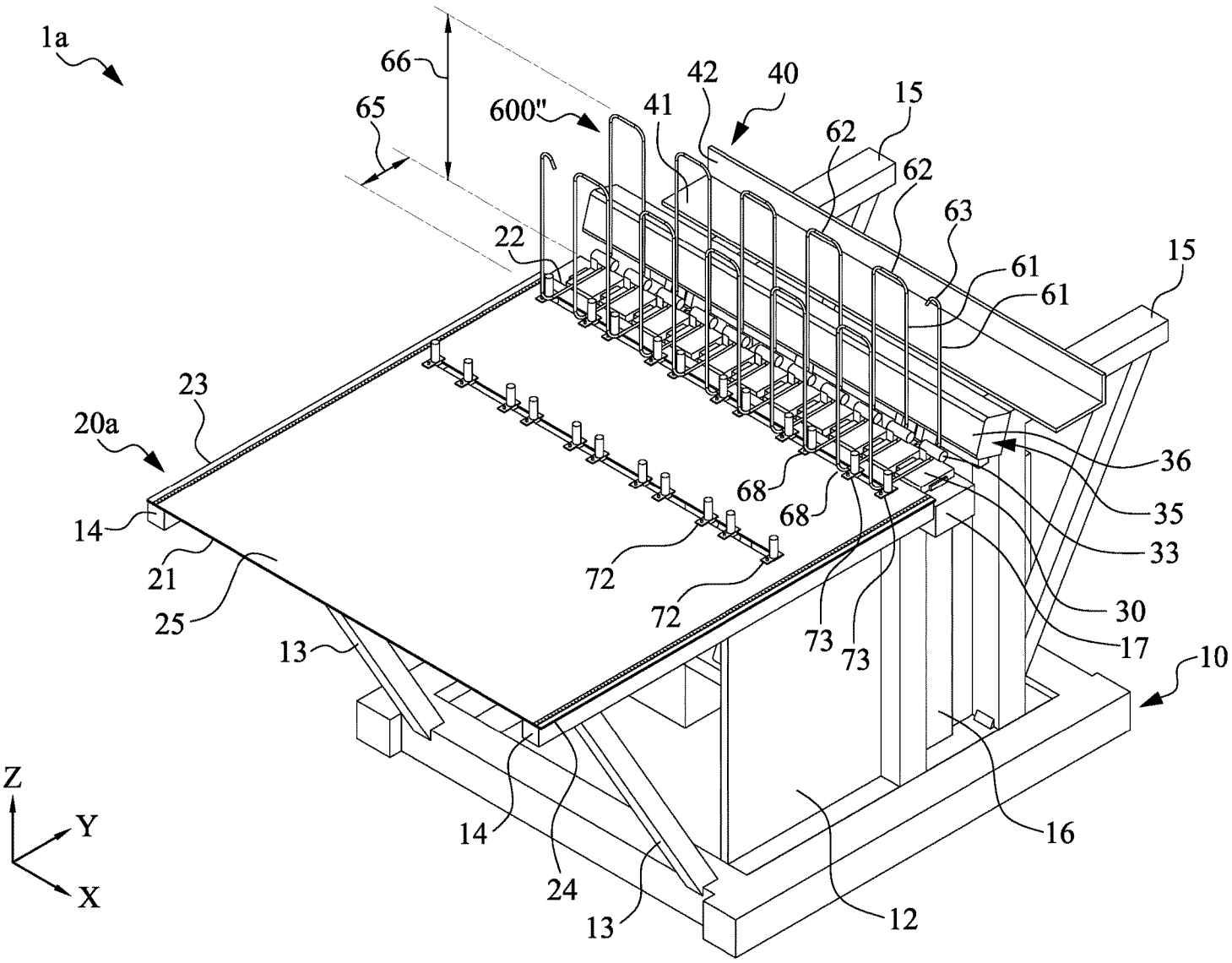
FIG. 18 is a schematic view of a fourth stage of a method for forming a continuous stirrup, in accordance with the second embodiment of the invention.

As shown in FIG. 18, the method for manufacturing the continuous stirrup further includes impelling the elongated mold 35 to bend the second lateral region 67 upwards relative to the platform 20*a* to form the continuous stirrup 600". In some embodiments, since the position of the first segments 61 of the intermediate structure 600' along the transverse orientation (X-axis) is limited by the second positioning members 73, when the second lateral region 67 of the intermediate structure 600' is impelled by the elongated mold 35, shifting or skewing of the first segments 61 of the intermediate structure 600' can be prevented. Therefore, the bent first segments 61 of the intermediate structure 600' remain substantially parallel along the longitudinal orientation (Y-axis.) In some embodiments, the method of making the continuous stirrup 600" further includes, after bending the second lateral region 67, unloading the continuous stirrup 600" from the continuous stirrup manufacturing apparatus 1*a*.

The foregoing embodiments merely describe the principle and effects of the present disclosure, and should not be used to limit the present disclosure. Therefore, persons skilled in the art can make modifications to and variations of the above embodiments without departing from the spirit of the present disclosure. The scope of the present disclosure should be defined by the appended claims.

What is claimed is:

1. A method for manufacturing a continuous stirrup, the method comprising:

bending a rebar to form a planar structure, wherein the planar structure has a wavy shape and comprises a plurality of first segments being disposed along a transverse orientation and substantially parallel along a longitudinal orientation and a plurality of second segments each extending along the transverse orientation and alternatively connecting ends of two adjacent first segments, and the planar structure has a first end and a second end opposite to the first end in the longitudinal orientation, wherein the planar structure is defined as a first lateral region proximate to the first end, a second lateral region proximate to the second end, and an intermediate region between the first lateral region and the second lateral region;

providing a jig on a platform, the jig including an elongated body and a plurality of positioning members arranged on the elongated body along the transverse orientation;

placing the planar structure on the platform to abut the first segments of the planar structure against the positioning members and extend the first lateral region from a front edge of the platform;

providing an elongated mold that extends along the transverse orientation in such a manner that the elongated mold is able to abut against at least a portion of the first lateral region of the planar structure;

impelling the elongated mold to abut against the first lateral region so that the first lateral region is bent upward relative to the platform to form an intermediate structure from the planar structure;

flipping the intermediate structure to abut the bent portions of the intermediate structure against the elongated body and the positioning members and extend the second lateral region from the front edge of the platform; and impelling the elongated mold to abut against the second lateral region so that the second lateral region is bent upward relative to the platform.

2. The method for manufacturing a continuous stirrup of claim 1, further comprising providing a plurality of bending structures that are arranged along the transverse orientation and spaced apart from each by a predetermined distance, each of the bending structures having a curved surface that is adjacent to and substantially parallel to the elongated mold.

3. The method for manufacturing a continuous stirrup of claim 2, wherein the step of providing a jig on a platform comprises: moving the jig from a rear edge of the platform to the front edge of the platform to have the jig positioned over the second lateral region of the planar structure.

4. The method for manufacturing a continuous stirrup of claim 3, wherein placing the planar structure on the platform comprises:

positioning the first segments in the first lateral region of the planar structure underneath the bending structures.

5. The method for manufacturing a continuous stirrup of claim 1, further comprising providing a size-determining member at one side of the elongated mold, wherein the size-determining member and the jig are positioned at opposing sides of the elongated mold.

6. The method for manufacturing a continuous stirrup of claim 5, further comprising adjusting a distance between the size-determining member and the elongated mold so as to have the first ends of the planar structure abutted against the size-determining member.

7. A method for manufacturing a continuous stirrup, comprising:

bending a rebar to form a planar structure, wherein the planar structure has a wavy shape and includes a plurality of first segments being disposed along a transverse orientation and substantially parallel along a longitudinal orientation and a plurality of second segments extending along the transverse orientation and alternatively connecting ends of two adjacent first segments, and the planar structure has a first end and a second end opposite to the first end in the longitudinal orientation, wherein the planar structure is defined as a first lateral region proximate to the first end, a second lateral region proximate to the second end, and an intermediate region between the first lateral region and the second lateral region;

providing a platform which comprises a first groove and a second groove formed therein, wherein the first groove and the second groove are substantially parallel and extend along the transverse orientation, and the second groove is located between the first groove and a front edge of the platform;

fixing a plurality of first positioning members in the first groove of the platform;

placing the planar structure on the platform to abut the first segments of the planar structure against the first positioning members and extend the first lateral region from a front edge of the platform;

providing an elongated mold that extends along the transverse orientation in such a manner that the elongated mold is able to abut against at least a portion of the first lateral region of the planar structure;

impelling the elongated mold to abut against the first lateral region so that the first lateral region is bent upward relative to the platform to form an intermediate structure from the planar structure;

fixing a plurality of second positioning members in the second groove of the platform;

flipping the intermediate structure to have the bent portions of the intermediate structure abutted against the second positioning members and extend the second lateral region from the front edge of the platform; and impelling the elongated mold to abut against the second lateral region so that the second lateral region is bent upward relative to the platform.

8. The method for manufacturing a continuous stirrup of claim 7, further comprising providing a plurality of bending structures that are arranged along the transverse orientation and spaced apart from each by a predetermined distance, each of the bending structures having a curved surface that is adjacent to and substantially parallel to the elongated mold.

9. The method for manufacturing a continuous stirrup of claim 8, wherein placing the planar structure on the platform comprising: positioning the first segments in the first lateral region of the planar structure underneath the bending structures.

10. The method for manufacturing a continuous stirrup of claim 8, further comprising providing a size-determining member at one side of the elongated mold, wherein the size-determining member and the first positioning members are positioned at opposing sides of the elongated mold.

11. The method for manufacturing a continuous stirrup of claim 10, further comprising adjusting a distance between the size-determining member and the elongated mold so as to have the first ends of the planar structure abutted against the size-determining member.

12. The method for manufacturing a continuous stirrup of claim 7, wherein placing the planar structure on the platform comprises simultaneously abutting each of the first segments against one of the first positioning members and corresponding one of the second positioning members.

13. A continuous stirrup manufacturing apparatus for bending a rebar having a wavy shape, the rebar extending in a plane and comprising a plurality of first segments being disposed along a transverse orientation and substantially parallel along a longitudinal orientation and a plurality of second segments each extending along the transverse orientation and alternatively connecting ends of two adjacent first segments, the continuous stirrup manufacturing apparatus comprising:

a platform, having a front edge;

a jig, comprising:

an elongated body extending parallel to the transverse orientation slidable on the platform along the longitudinal orientation; and a plurality of positioning members disposed on the elongated body and is configured to abut against the first segments of the rebar;

an elongated mold disposed adjacent to the front edge of the platform and being movable relative to the platform so as to abut against the first segments extending from the front edge of the platform and bend upwards relative to the first segments; and a plurality of bending members arranged along the transverse orientation and spaced apart from each by a predetermined distance, the bending members being adjacent and substantially parallel to the elongated mold.

14. The continuous stirrup manufacturing apparatus of claim 13, wherein a lower surface of the elongated body is distant from the platform, and the positioning members are disposed on the lower surface of the elongated body.

15. The continuous stirrup manufacturing apparatus of claim 14, wherein each of the positioning members has a curved shape and has two ends extending outwards and away from the first segment against which the positioning member abuts.

16. The continuous stirrup manufacturing apparatus of claim 14, further comprising a size-determining member facing the front edge of the platform wherein the size-determining member and the jig are disposed at opposing sides of the elongated mold and wherein the size-determining member is movable relative to the elongated mold and is configured to abut against the first segments so as to control the length of the portions of the first segments extending from the front edge of the platform.

17. A continuous stirrup manufacturing apparatus for bending a rebar having a wavy shape, the rebar extending in a plane and comprising a plurality of first segments being disposed along a transverse orientation and substantially parallel along a longitudinal orientation and a plurality of second segments each extending along the transverse orientation and alternatively connecting ends of two adjacent first segments, the continuous stirrup manufacturing apparatus comprising:

a platform, having a front edge and a first groove extending parallel to the front edge;

a plurality of first positioning members arranged along the first groove and configured to abut against and position the first segments of the rebar;

an elongated mold positioned adjacent to the front edge of the platform and being movable relative to the platform so as to abut against the first segments extending from the front edge of the platform and bend upwards relative to the first segments; and a plurality of bending members arranged along the transverse orientation and spaced apart from each by a predetermined distance, the bending members being adjacent and substantially parallel to the elongated mold.

18. The continuous stirrup manufacturing apparatus of claim 17, wherein each of the bending members comprises a rectangular base, a bending structure and a connecting portion configured to connect the bending structure to and fixed at the rectangular base, wherein the bending structure has a curved outer surface.

19. The continuous stirrup manufacturing apparatus of claim 17, wherein the platform further includes a second groove positioned closer to the front edge of the platform than the first groove, and the continuous stirrup manufacturing apparatus further comprises:

a plurality of second positioning members arranged along the second groove, wherein each of the second positioning members and corresponding one of the first positioning members are configured to abut against opposing sides of one of the first segments.

20. The continuous stirrup manufacturing apparatus of claim 18, further comprising a size-determining member facing the front edge of the platform wherein the size-determining member and the jig are disposed at opposing sides of the elongated mold and wherein the size-determining member is movable relative to the elongated mold and is configured to abut against the first segments so as to control the length of the portions of the first segments extending from the front edge of the platform.

* * * * *